US010087116B2

(12) United States Patent
Warrender et al.

(10) Patent No.: US 10,087,116 B2
(45) Date of Patent: Oct. 2, 2018

(54) BURN RATE MODIFIER

(71) Applicant: Thales Australia Limited, New South Wales (AU)

(72) Inventors: Garry Warrender, New South Wales (AU); Ashley Jones, New South Wales (AU)

(73) Assignee: Thales Australia Limited, Sydney Olympic Park, New South Wales (AU)

( * ) Notice: Subject to any disclaimer, the term of this patent is extended or adjusted under 35 U.S.C. 154(b) by 148 days.

(21) Appl. No.: 15/023,672

(22) PCT Filed: Sep. 24, 2014

(86) PCT No.: PCT/AU2014/000933
§ 371 (c)(1),
(2) Date: Mar. 21, 2016

(87) PCT Pub. No.: WO2015/042640
PCT Pub. Date: Apr. 2, 2015

(65) Prior Publication Data

US 2016/0244382 A1 Aug. 25, 2016

(30) Foreign Application Priority Data

Sep. 24, 2013 (AU) ..... 2013903680

(51) Int. Cl.
*C06B 31/00* (2006.01)
*C06B 23/00* (2006.01)
(Continued)

(52) U.S. Cl.
CPC ..... *C06B 23/007* (2013.01); *C06B 25/20* (2013.01); *C06B 45/10* (2013.01); *C06B 45/22* (2013.01); *F42B 5/02* (2013.01); *F42B 5/16* (2013.01)

(58) Field of Classification Search
USPC ..... 149/45, 109.4, 109.6
See application file for complete search history.

(56) References Cited

U.S. PATENT DOCUMENTS 1,561,219 A 11/1925 Davis
2,349,048 A 5/1944 Mackey et al.
(Continued)

FOREIGN PATENT DOCUMENTS

CN 1673270 9/2005
EP 0455373 A1 11/1991
(Continued)

OTHER PUBLICATIONS

Echa, "Member State Committee Support Document for Identification of 2,4-Dinitrotoluene as a Substance of Very High Concern Because of Its CMR Properties" Adopted on Nov. 27, 2009 (10 pages).

(Continued)

*Primary Examiner* — James E McDonough
(74) *Attorney, Agent, or Firm* — Michael Best & Friedrich LLP

(57) ABSTRACT

The invention relates generally to burn rate modifiers, plasticizers and propellants comprising a burn rate modifier and/or a plasticizer. The invention also relates to methods of producing a propellant comprising a burn rate modifier and/or a plasticizer as well as an ammunition cartridge comprising the propellant. The burn rate modifier and/or plasticiser comprises a compound of formula (1) (Formula (1)) and the propellant comprises a compound of formula 1 and an energetic material.

(Continued)

(1)

20 Claims, 2 Drawing Sheets

(51) Int. Cl.

| | |
|---|---|
| ***C06B 45/10*** | (2006.01) |
| ***C06B 45/22*** | (2006.01) |
| ***C06B 25/20*** | (2006.01) |
| ***F42B 5/02*** | (2006.01) |
| ***F42B 5/16*** | (2006.01) |
| *D03D 23/00* | (2006.01) |
| *D03D 43/00* | (2006.01) |

(56) References Cited

U.S. PATENT DOCUMENTS

| | | | |
|---|---|---|---|
| 2,407,967 | A | 9/1946 | Thomson |
| 2,432,578 | A | 12/1947 | Lindsten |
| 2,771,351 | A | 11/1956 | Holmes et al. |
| 2,917,379 | A | 12/1959 | Alton |
| 3,108,916 | A | 10/1963 | Coffee et al. |
| 3,147,161 | A | 9/1964 | Abere et al. |
| 3,743,554 | A | 7/1973 | Mellow |
| 3,798,085 | A | 3/1974 | Mellow |
| 3,986,907 | A | 10/1976 | Dillehay |
| 4,300,961 | A | 11/1981 | Williams |
| 4,354,884 | A | 10/1982 | Williams |
| 4,950,342 | A | 8/1990 | Canterberry |
| 5,066,484 | A | 11/1991 | Castrogiovanni et al. |
| 5,510,062 | A | 4/1996 | O'Meara et al. |
| 5,524,544 | A | 6/1996 | O'Meara et al. |
| 5,682,009 | A | 10/1997 | O'Meara et al. |
| 6,345,577 | B1 | 2/2002 | Cramer et al. |
| 6,692,655 | B1 * | 2/2004 | Martins ..... C06B 21/0058 149/17 |
| 7,473,330 | B2 | 1/2009 | Ryf et al. |
| 2002/0058213 | A1 | 5/2002 | Mikoshiba et al. |
| 2006/0083701 | A1 * | 4/2006 | Pagano ..... A61K 8/8152 424/61 |
| 2008/0229964 | A1 * | 9/2008 | Cranor ..... F42B 12/40 102/513 |
| 2013/0133549 | A1 | 5/2013 | Conterno |

FOREIGN PATENT DOCUMENTS

| | | | |
|---|---|---|---|
| EP | 2599827 | A1 | 6/2013 |
| JP | H04-225908 | A | 8/1992 |
| JP | 2005128300 | | 5/2005 |
| JP | 2006-071179 | A | 3/2006 |
| JP | 2007-063310 | A | 3/2007 |
| JP | 2007-085632 | A | 4/2007 |
| JP | 2011-208048 | A | 10/2011 |
| JP | 2013-112821 | A | 6/2013 |
| WO | 2007132615 | | 11/2007 |
| WO | 2008127769 | | 10/2008 |
| WO | 2011/153655 | A2 | 12/2011 |

OTHER PUBLICATIONS

Mann et al., "Development of a Deterred Propellant for a Large Caliber Weapon System" Journal of Hazardous Materials, vol. 7, Issue 3, 1983, pp. 259-280.

Stiefel, "Thermochemical and Burn Rate Properties of Deterred US Small Arms Propellants" No. ARSCD-TR-80005. Army Armament Research and Development Command, Center Fire Control and Small Caliber Weapon Systems Laboratory, 1980 (59 pages).

International Search Report and Written Opinion for Application No. PCT/AU2014/000933 dated Oct. 15, 2014 (11 pages).

Fourcade et al., "Renewable resource-based epoxy resins derived from multifunctional poly (4-hydroxybenzoates)." Green Chemistry, 2013, 15(4), 910-918.

Singh et al., "Identification of polyalcohols from Rauwolfia serpentina Benth. Seeds periodate oxidized polysaccharide by Smith degradation technique." Indian Journal of Applied and Pure Biology, 2009, 24(1), 87-90.

Francis et al., "The acetolysis of some hydroxytetrahydro-2-pyrans." Canadian Journal of Chemistry, 1959, 37, 972-978.

Jacquemain et al., "Sur un complex iodo-argento-nitrobenzoique et son action sur quelques dérivés allyliques." Comptes Rendus, 1936, 202, 497-499.

Bauer, "Zur Umsäuerung von Glyceriden." Berichte der Deutschen Chemischen Gesellschaft [Abteilung] B: Abhandlungen, 1924, 57B, 897-899.

Paulsen et al., "Darstellung von Acyloxonium-lonen <lurch Einwirkung von Trifluormethansulfonsäure auf Diol- und Triolester." Chemische Berichte, 1975, 108, 3176-3189.

Sakuda et al., "Blasticidin A as an Inhibitor of Aflatoxin Production by Aspergillus parasiticus." Journal of Antibiotics, 2000, 53(11), 1265-1271.

Tisserand et al., "Contribution a l'etude de la transposition des groupements aroyloxy des esters benzoiques de l'alcool allylique au cours de leur action sur les complexes iodo-argentobenzoiques", Annales Scientifiques de l'Universite de Besangon, 1968, 3(6), 23-39.

CAS RN 22576-79-0, STN dated Nov. 16, 1984 (1 page).

CAS RN 851223-21-7, STN dated May 26, 2005 (1 page).

CAS RN 365453-17-4, STN dated Oct. 30, 2001 (1 page).

Japanese Patent Office Action for Application No. 2016-546125 dated Mar. 20, 2018 (4 pages, Statement of relevance Included).

* cited by examiner

BURN RATE MODIFIER

FIELD

The invention relates generally to burn rate modifiers, plasticizers and propellants comprising a burn rate modifier and/or a plasticizer. The invention also relates to methods of producing a propellant comprising a burn rate modifier and/or a plasticizer as well as an ammunition cartridge comprising the propellant.

BACKGROUND

Propellant performance is determined from its ability to convert chemical energy into mechanical energy through the evolution of heat and gases that apply pressure to the base of a projectile moving it down the bore of a barrel. Many factors influence this process. Chemical composition is one important characteristic and another is grain morphology (shape and size) which has a profound effect on the burning rate. To arrive at an optimised propellant design it must be understood that the materials, processing conditions, physical properties and chemical properties are all interlinked to determine propellant performance. The goal is to achieve efficient combustion with optimised loadability to deliver improved ballistic performance. In addition, other aspects such as improving shelf life of the propellant or ensuring ballistic consistency over temperature extremes are also important. It is also recognized that new propellant formulations and production processes are required in order to improve efficiency and meet more stringent safety, toxicity and environmental impact requirements.

To improve propellant performance, and to prevent dangerously high pressure build up, a burn deterrent (or burn rate modifier) may be added to the propellant to regulate the burn rate in the initial part of the ballistic process. This is typically achieved by coating a chemical onto a propellant grain. The chemical can penetrate to some extent into the grain matrix and acts to slow the burning reaction (by interrupting the chain reaction of burning) or the chemical is cooler burning. Burn deterrents that function by interrupting the chain reaction of burning do so by stabilising free radicals. This stabilisation extends the lifetime of the radicals, slows the rate of the radical processes and subsequently, there is less, or slower, combustion.

An example of a burn rate deterrent is dinitrotoluene (DNT). DNT is an effective burn deterrent because it is relatively easy to apply, stable over long periods and is chemically compatible with propellants such as nitrocellulose which is the major energetic component of most small arms propellants. However, it is highly toxic and a suspected carcinogen which makes it a chemical of concern. Recent legislation (such as Registration, Evaluation, Authorisation and Restriction of Chemicals (REACH) under the European Union) has resulted in the use of DNT being highly regulated with the potential for DNT to be banned in Europe. Due to its characteristics, DNT has associated environmental problems in that it builds up in and around factory buildings, migrates very slowly into the soil and breaks down slowly.

Other currently available burn rate modifiers, such as dibutylphthalate (DBP), are also on the substance of concern list and are likely to be banned. It is anticipated that materials such as DNT and DBP will also have tighter restriction applied as other countries adopt more stringent safety and environmental regulations.

There therefore exists a need for an alternative burn rate modifier to DNT and other burn rate modifiers currently in use.

SUMMARY

Accordingly, in a first aspect of the present invention, there is provided a burn rate modifier and for plasticizer comprising a compound of formula 1

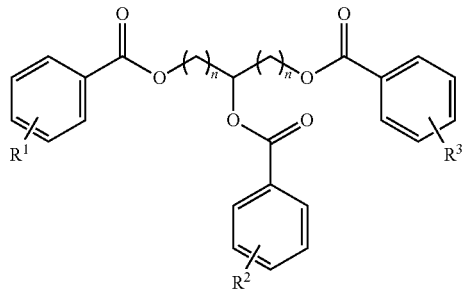

wherein $R^1$ is selected from the group consisting of —H, —OH, —O($C_{1-4}$alkyl), —$C_{1-4}$alkyl, —NH$C_{1-4}$alkyl, —N($C_{1-4}$alkyl)$_2$, —$NO_2$, —$NHNH_2$, —N($C_{1-4}$alkyl)$NH_2$, and —CN;

$R^2$ is selected from the group consisting of —H, —OH, —O($C_{1-4}$alkyl), —$C_{1-4}$alkyl, —NH$C_{1-4}$alkyl, —N($C_{1-4}$alkyl)$_2$, —$NO_2$, —$NHNH_2$, —N($C_{1-4}$alkyl)$NH_2$, and —CN;

$R^3$ is selected from the group consisting of —H, —OH, —O($C_{1-4}$alkyl), —$C_{1-4}$alkyl, —NH$C_{1-4}$alkyl, —N($C_{1-4}$alkyl)$_2$, —$NO_2$, —$NHNH_2$, —N($C_{1-4}$alkyl)$NH_2$, and —CN; and n is an integer from 1 to 4.

The present applicant has conducted considerable research and development over an extensive period of time to develop a new burn rate modifier having burn rate modification properties making it a suitable substitute for toxic burn rate modifiers like DNT in propellants for ammunition.

The applicant has developed this new burn rate modifier based on glycerol tribenzoate, and derivatives thereof within formula 1. The applicant has found that this new burn rate modifier has burn rate modification properties just as good as DNT, but without the drawbacks of toxicity and carcinogenicity. In fact, the new burn rate modifier has surprisingly better burn rate modification properties than even the industry-preferred DNT, making it suitable for use in propellants and ammunition cartridges. The burn rate modifier also has plasticization properties allowing it to be used in addition to, or instead of, toxic plasticizers like dibutylphthalate (DBP) in propellants for ammunition.

The compound of formula 1 could be chosen to function as a burn rate modifier or as a plasticizer depending on its intended use. The compound of formula 1 could be chosen to function as both a burn rate modifier and a plasticizer.

According to a second aspect, there is also provided the use of the compound of formula 1 as a burn rate modifier and/or a plasticizer.

According to a third aspect, there is provided a compound of formula 1 for use as a burn rate modifier and/or a plasticizer.

In some embodiments, the compound of formula 1 is glycerol tribenzoate. Although this compound is preferred, it is appreciated that closely structurally and physical property-related compounds may also provide further alternative burn rate modifiers to DNT or may provide further alternative plasticizers to DBP.

According to a fourth aspect, there is provided a propellant comprising an energetic material; and a compound of formula 1

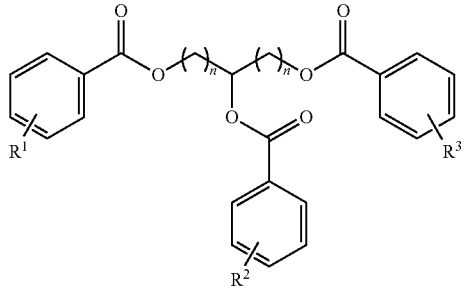

wherein $R^1$ is selected from the group consisting of —H, —OH, —O($C_{1-4}$alkyl), —$C_{1-4}$alkyl, —NH$C_{1-4}$alkyl, —N($C_{1-4}$alkyl)$_2$, —$NO_2$, —$NHNH_2$, —N($C_{1-4}$alkyl)$NH_2$, and —CN;

$R^2$ is selected from the group consisting of —H, —OH, —O($C_{1-4}$alkyl), —$C_{1-4}$alkyl, —NH$C_{1-4}$alkyl, —N($C_{1-4}$alkyl)$_2$, —$NO_2$, —$NHNH_2$, —N($C_{1-4}$alkyl)$NH_2$, and —CN;

$R^3$ is selected from the group consisting of —H, —OH, —O($C_{1-4}$alkyl), —$C_{1-4}$alkyl, —NH$C_{1-4}$alkyl, —N($C_{1-4}$alkyl)$_2$, —$NO_2$, —$NHNH_2$, —N($C_{1-4}$alkyl)$NH_2$, and —CN; and n is an integer from 1 to 4.

In some embodiments, the compound of formula 1 is dispersed throughout granules of the energetic material. In some embodiments, the compound of formula 1 is in the form of a coating on granules of the energetic material. In some embodiments, the compound of formula 1 is dispersed throughout granules of the energetic material and is in the form of a coating on the granules.

In some embodiments, the compound of formula 1 is a burn rate modifier and the propellant comprises one or more additional burn rate modifiers. The additional burn rate modifier(s) is generally of a different chemical identity to the first burn rate modifier.

Test work conducted by the present applicant shows that the propellant is chemically stable.

In a fifth aspect, there is provided an ammunition cartridge comprising the propellant according to the fourth aspect.

The ammunition cartridge typically comprises a casing, the propellant described above, a primer and a projectile.

According to a sixth aspect, there is provided a method of preparing a propellant, comprising coating granules of an energetic material with a compound of formula 1

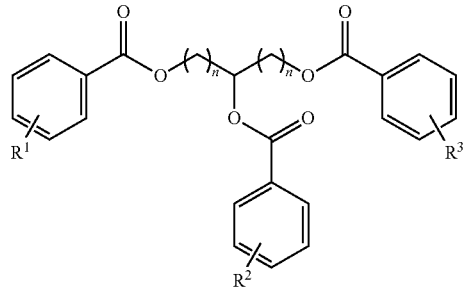

wherein $R^1$ is selected from the group consisting of —H, —OH, —O($C_{1-4}$alkyl), —$C_{1-4}$alkyl, —NH$C_{1-4}$alkyl, —N($C_{1-4}$alkyl)$_2$, —$NO_2$, —$NHNH_2$, —N($C_{1-4}$alkyl)$NH_2$, and —CN;

$R^2$ is selected from the group consisting of —H, —OH, —O($C_{1-4}$alkyl), —$C_{1-4}$alkyl, —NH$C_{1-4}$alkyl, —N($C_{1-4}$alkyl)$_2$, —$NO_2$, —$NHNH_2$, —N($C_{1-4}$alkyl)$NH_2$, and —CN;

$R^3$ is selected from the group consisting of —H, —OH, —O($C_{1-4}$alkyl), —$C_{1-4}$alkyl, —NH$C_{1-4}$alkyl, —N($C_{1-4}$alkyl)$_2$, —$NO_2$, —$NHNH_2$, —N($C_{1-4}$alkyl)$NH_2$, and —CN; and n is an integer from 1 to 4.

According to a seventh aspect, there is provided a method of preparing a propellant, comprising dispersing a compound of formula 1

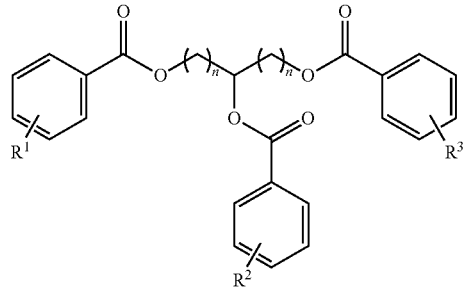

wherein $R^1$ is selected from the group consisting of —H, —OH, —O($C_{1-4}$alkyl), —$C_{1-4}$alkyl, —NH$C_{1-4}$alkyl, —N($C_{1-4}$alkyl)$_2$, —$NO_2$, —$NHNH_2$, —N($C_{1-4}$alkyl)$NH_2$, and —CN;

$R^2$ is selected from the group consisting of —H, —OH, —O($C_{1-4}$alkyl), —$C_{1-4}$alkyl, —NH$C_{1-4}$alkyl, —N($C_{1-4}$alkyl)$_2$, —$NO_2$, —$NHNH_2$, —N($C_{1-4}$alkyl)$NH_2$, and —CN;

$R^3$ is selected from the group consisting of —H, —OH, —O($C_{1-4}$alkyl), —$C_{1-4}$alkyl, —NH$C_{1-4}$alkyl, —N($C_{1-4}$alkyl)$_2$, —$NO_2$, —$NHNH_2$, —N($C_{1-4}$alkyl)$NH_2$, and —CN; and n is an integer from 1 to 4 throughout an energetic material and granulating the energetic material.

These aspects are described more fully in the detailed description below.

BRIEF DESCRIPTION OF THE DRAWINGS

The invention will be described in further detail, by way of example only, with reference to the following Figures.

DETAILED DESCRIPTION

Figure 1:
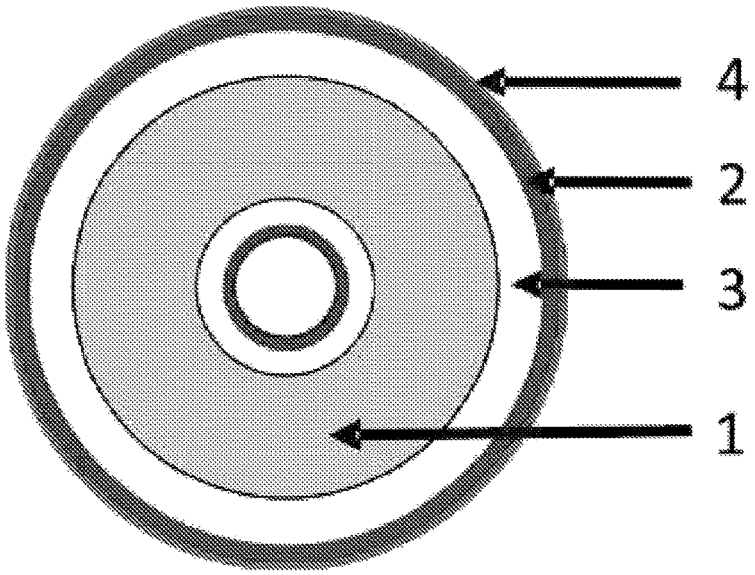
FIG. 1 is a schematic illustration showing the composition of a propellant according to one embodiment of the invention.

The invention relates generally to burn rate modifiers, plasticizers and propellants comprising a burn rate modifier and/or a plasticizer. The invention also relates to methods of producing a propellant comprising a burn rate modifier and/or a plasticizer as well as an ammunition cartridge comprising the propellant.

In the following, we have described features of the method and the burn rate modifier, plasticizer and propellant. All features described below apply independently to the methods and the products of the invention.

Compounds

The present invention involves the use of a compound of formula 1

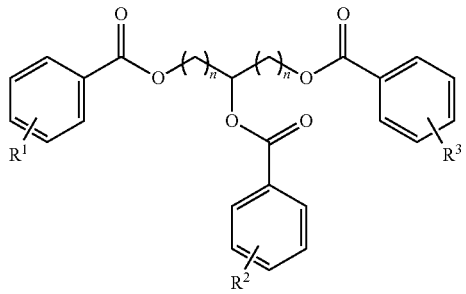

wherein $R^1$ is selected from the group consisting of —H, —OH, —O($C_{1-4}$alkyl), —$C_{1-4}$alkyl, —NH$C_{1-4}$alkyl, —N($C_{1-4}$alkyl)$_2$, —$NO_2$, —$NHNH_2$, —N($C_{1-4}$alkyl)$NH_2$, and —CN;

$R^2$ is selected from the group consisting of —H, —OH, —O($C_{1-4}$alkyl), —$C_{1-4}$alkyl, —NH$C_{1-4}$alkyl, —N($C_{1-4}$alkyl)$_2$, —$NO_2$, —$NHNH_2$, —N($C_{1-4}$alkyl)$NH_2$, and —CN;

$R^3$ is selected from the group consisting of —H, —OH, —O($C_{1-4}$alkyl), —$C_{1-4}$alkyl, —NH$C_{1-4}$alkyl, —N($C_{1-4}$alkyl)$_2$, —$NO_2$, —$NHNH_2$, —N($C_{1-4}$alkyl)$NH_2$, and —CN; and n is an integer from 1 to 4.

In some embodiments $R^1$ is selected from the group consisting of —H, —OH, —O—($C_{1-4}$alkyl) and —$C_{1-4}$alkyl. In other embodiments, $R^1$ is selected from the group consisting of —H, —OH and —O—($C_{1-4}$alkyl). In some preferred embodiments, $R^1$ is selected from the group consisting of —H and —OH. In a particularly preferred embodiment, $R^1$ is —H.

$R^1$ may be in any position around the aromatic ring. For example, $R^1$ may be in the ortho, meta or para position. In some embodiments, $R^1$ is in the para position.

In some embodiments $R^2$ is selected from the group consisting of —H, —OH, —O—($C_{1-4}$alkyl) and —$C_{1-4}$alkyl. In other embodiments, $R^2$ is selected from the group consisting of —H, —OH and —O—($C_{1-4}$alkyl). In some preferred embodiments, $R^2$ is selected from the group consisting of —H and —OH. In a particularly preferred embodiment, $R^2$ is —H.

$R^2$ may be in any position around the aromatic ring. For example, $R^2$ may be in the ortho, meta or para position. In some embodiments, $R^2$ is in the para position.

In some embodiments $R^3$ is selected from the group consisting of —H, —OH, —O—($C_{1-4}$alkyl) and —$C_{1-4}$alkyl. In other embodiments, $R^3$ is selected from the group consisting of —H, —OH and —O—($C_{1-4}$alkyl). In some preferred embodiments, $R^3$ is selected from the group consisting of —H and —OH. In a particularly preferred embodiment, $R^3$ is —H.

$R^3$ may be in any position around the aromatic ring. For example, $R^3$ may be in the ortho, meta or para position. In some embodiments, $R^3$ is in the para position.

In some embodiments, n is an integer from 1 to 3. In other embodiment, n is 1 or 2. In particularly preferred embodiments, n is 1.

In one embodiment, $R^1$, $R^2$ and $R^3$ are —H and n is 1.

The compound of formula 1 may function as a burn rate modifier. The burn rate modifier may specifically be a burn rate deterrent. The burn rate modifier or burn rate deterrent may alternatively be referred to as a burn deterrent.

The compound of formula 1 may function as a plasticizer. The term "plasticizer" refers to a compound which imparts homogeneity and plasticity to the energetic material.

The compound of formula 1 may function as a burn rate modifier and a plasticizer. In this respect, the compound of formula 1 may be referred to as a plasticizing burn rate modifier. The compound of formula 1 may be referred to in the context of one function but should be read as functioning either as a burn rate modifier or as a plasticizer or as a plasticizing burn rate modifier.

The compound of formula 1 preferably has a melting point of about 50 to about 90° C. For example, the melting point may be about 55 to about 85° C., such as about 60 to about 80° C., or about 65 to about 75° C. In some embodiments, the compound of formula 1 has a melting point of at least about 50° C. For example, the melting point may be at least about 60° C., such as at least about 65° C., or at least about 70° C.

In some embodiments, the compound of formula 1 is glycerol tribenzoate.

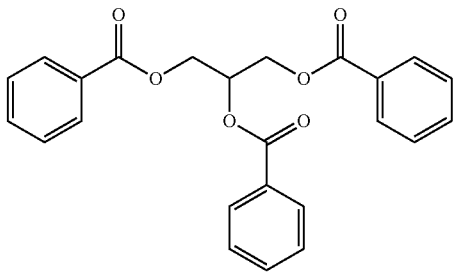

Although this compound is preferred, it is appreciated that closely structurally and physical property-related compounds may also perform as per glycerol tribenzoate.

Tests were conducted by the applicant demonstrating the efficacy of glycerol tribenzoate as a burn rate modifier and/or plasticizer. The tests showed that glycerol tribenzoate has surprisingly better burn rate modification properties than even the industry-preferred DNT, but without the drawbacks of toxicity and carcinogenicity. In particular, glycerol tribenzoate enhances small grain propellant performance to the point where ballistic performance of the small grain is similar to a significantly larger granule that is coated with DNT. This enables more propellant to be loaded into a cartridge case, resulting in improved performance. The application of smaller grains for larger loads improves the efficiency of burning of the overall load, meaning less wastage of propellant, less flash from the muzzle and cleaner burning propellant loads—a desirable outcome for military ammunition. Previous grain formulations reliant on DNT as the burn rate modifier or DBP as the plasticizer could not deliver these outcomes to the same extent.

Energetic Material

The propellant of the present invention comprises an energetic material. The term energetic material includes any material which can be burned to generate a propellant gas to propel a projectile.

In some embodiments, the energetic material is selected from the group consisting of carbon black powder, ammonium perchlorate, hexogen, butanetrioltrinitrate, ethyleneglycol dintrate, diethyleneglycol dinitrate, erithritol tetranitrate, octogen, hexanitroisowurtzitane, metriol trinitrate, N-Methylnitramine, pentaerythritol tetranitrate, tetranitrobenzolamine, trinitrotoluene, nitroglcerine, nitrocellulose, mannitol hexanitrate, triethylene glycol dinitrate, guanidine, nitroguanidine, 3-nitro-1,2,4-triazol-5-one, ammonium nitrate, propanediol dinitrate, hexamine, 5-aminotetrazole, methyltetrazole, phenyltetrazole, polyglycidylnitrate, polyglycidylazide, poly[3-nitratomethyl-3-methyloxitane], poly[3-azidomethyl-3-methyloxitane], poly[3,3-bis(azidomethyl)oxitane], nitrated cyclodextrin polymers, poly glycidylnitrate, and combinations thereof.

In some specific embodiments, the energetic material is selected from the group consisting of nitroglycerin, nitrocellulose and combinations thereof.

In some embodiments, the propellant comprises a single energetic material. For example, the propellant may only comprise nitrocellulose. In such circumstances, the energetic material may be referred to as "single base" and the propellant may be referred to as "a single base propellant". In other embodiments, the propellant may comprise two energetic materials. For example, the propellant may comprise nitrocellulose and nitroglycerin. In such cases, the energetic material may be referred to as "double base" and the propellant may be referred to as "a double base propellant". In still other embodiments, the propellant may comprise more than two energetic materials. For example, the propellant may comprise nitrocellulose, nitroquanidine and nitroglycerin. In such circumstances, the energetic material may be referred to as "multiple base" and the propellant may be referred to as "a multiple base propellant".

In one embodiment, the energetic material is nitrocellulose.

The energetic material may be in any form that is suitable for incorporation into an ammunition cartridge for a firearm, or gun.

In some embodiments, the energetic material is in the form of granules. The term "granule" may also be referred to as "kernel" or "pellet".

The granules energetic material may be prepared by any method known in the art. For example, a slurry or dough of energetic material may be extruded, or energetic material in particulate form may be compressed into a granule of energetic material. In another embodiment, particulates of energetic material may be coalesced and shaped into agglomerates by pumping a slurry through shaping tubes. In some embodiments, the agglomerates may be substantially spherical in shape. The agglomerates may be referred to as particles.

In one embodiment, the energetic material is prepared by extruding a slurry or dough of energetic material to form an extrudate and granulating the extrudate. The term "granulating" refers to the process of dividing, or cutting, an extrudate into granules. In some embodiments, the slurry or dough of energetic material is extruded to form an extrudate cord and the extrudate cord is cut to the desired length to form granules. The granules may be of any size suitable for use in ammunition.

As a consequence of the processing steps described above, the granules may also be referred to as agglomerates, grains or particles.

The granules can be of any shape. In some embodiments, the granules have an axial dimension with a consistent cross-section. For example, the granule may have a substantially circular cross-section or the cross-section may be elliptical or any other similar shape. In some embodiments the granules are cylindrical in shape.

The granules may be of any size suitable for use in ammunition. In some embodiments, the granules are about 0.1 to about 25 mm in length. For example, the granules may be about 0.3 to about 20 mm in length, such as about 0.5 to about 12 mm in length, or about 0.7 to about 5 mm in length, or about 1 to about 2 mm in length.

In some embodiments, the granules have a diameter of about 0.1 to about 20 mm. For example, the granules may have a diameter of about 0.2 to about 15 mm, such as about 0.4 to about 12 mm, or about 0.5 to about 10 mm, or about 0.6 to about 5 mm, or about 0.7 to about 1 mm.

The granules may have a greater length than diameter. In these embodiments, the granules may be referred to as sticks. In some embodiments, the length of the sticks may be about 6 to about 14 mm, such as about 8 to about 12 mm. In some embodiments, the diameter of the sticks may be about 0.6 to about 1.2 mm, such as about 0.7 to about 1 mm.

After granulation, the granules are dried during which they may contract slightly. This contraction can be taken into account when granulating the granules or compressing the particulates of energetic material. The contracted granules may be of any size suitable to be used in ammunition. In some embodiments, the granules are about 0.1 to about 25 mm in length. For example, the granules may be about 0.3 to about 20 mm in length, such as about 0.5 to about 12 mm in length, or about 0.7 to about 5 mm in length, or about 1 to about 2 mm in length.

In some embodiments, the granules have a diameter of about 0.1 to about 20 mm. For example, the granules may have a diameter of about 0.2 to about 15 mm, such as about 0.4 to about 12 mm, or about 0.5 to about 10 mm, or about 0.6 to about 5 mm, or about 0.7 to about 1 mm.

When the contracted granules are sticks, the length of the sticks may be about 6 to about 14 mm, such as about 8 to about 12 mm. In some embodiments, the diameter of the sticks may be about 0.6 to about 1.2 mm, such as about 0.7 to about 1 mm.

In some embodiments, the granules comprise a perforation to enhance burning rates later in the burning cycle and to make the granules more progressive in burning. Expressed another way, in some embodiments, the granules comprise one or more perforations. Perforations increase the surface area of the granule and can result in a further moderated burn rate upon application of the compound of formula 1. In some embodiments, the perforations result in further moderated burn rate in the early stages of the ballistic cycle.

The term "perforation" refers to an aperture in the granule. Alternative terms for "perforation" are channel, bore and cavity. The perforation may extend all the way through the granule. In some embodiments, the perforation extends axially through the granule.

The perforation may be of any diameter suitable for the size of the granule. In some embodiments, the perforation has a diameter of about 50 to about 1000 μm. For example, the perforation may have a diameter of about 50 to about 700 μm, such as about 50 to about 500 μm, or about 100 to about 300 μm.

There may be more than one perforation in each granule. In some embodiments, there is a single perforation. In other embodiments, there are multiple perforations. In one particular embodiment, there is a single central perforation. In other embodiments there are at least 2 perforations, for example, at least 3 perforations, or at least 4 perforations, or at least 5 perforations.

When the energetic material is made by extrusion, the extrudate may be extruded with one or more perforations.

The Propellant

The propellant comprises an energetic material and a compound of formula 1. The energetic material and compound of formula 1 may be combined in any way. In some embodiments, the compound of formula 1 is in the form of a coating on granules of the energetic material. Therefore, in one embodiment, there is provided a method of preparing a propellant comprising coating granules of an energetic material with a compound of formula 1. In some embodiments, the compound of formula 1 is dispersed throughout granules of the energetic material. Therefore, in one embodiment, there is provided a method of preparing a propellant comprising dispersing a compound of formula 1 throughout an energetic material and granulating the energetic material.

In embodiments where the compound of formula 1 is dispersed throughout granules of energetic material, the compound of formula 1 may function as a plasticizer. In this circumstance, the compound of formula 1 may additionally function as a burn rate modifier. In either case, a burn rate modifier coating material may be coated onto the granules of energetic material. The burn rate modifier coating material can be a compound of formula 1 that is the same or different to the compound of formula 1 dispersed in the granules. Alternatively, the burn rate modifier coating material may be any burn rate modifier known in the art. Examples of suitable burn rate modifiers include, but are not limited to, dintirotoluene, acetyl triethyl citrate, triethyl citrate, tri-n-butyl citrate, tributyl acetyl citrate, acetyl tri-n-butyl citrate, acetyl tri-n-hexyl citrate, n-butyryl tri-n-hexylcitrate, di-n-butyl adipate, diisopropyl adipate, diisobutyl adipate, diethylhexyl adipate, nonyl undecyl adipate n-decyl-n-octyl adipate, dibutoxy ethoxy ethyl adipate dimethyl adipate, hexyl octyl decyl adipate diisononyl adipate, dibutyl phthalate, diethyl phthalate, diamyl phthalate, nonylundecyl phthalate, bis(3,5,5-trimethylhexyl) phthalate, di-n-propyladipate, di-n-butyl sebacate, dioctyl sebacate, dimethyl sebacate, diethyl diphenyl urea, dimethyl diphenyl urea, di-n-butyl phthalate, di-n-hexyl phthalate, dinonyl undecyl phthalate, nonyl undecyl phthalate, dioctyl terephthalate, dioctyl isophthalate, 1,2-cyclohexane dicarbonic acid diisononylester, dibutyl maleate, dinonyl maleate, diisooctyl maleate, dibutyl fumarate, dinonyl fumarate, dimethyl sebacate, dibutyl sebacate, diisooctyl sebacate, dibutyl azelate, diethylene glycol dibenzoate, trioctyl trimelliate, trioctyl phosphate, butyl stearate, methylphenylurethane, N-methyl-N-phenylurethane, ethyl diphenyl carbamate, camphor, gum arabic, gelatin, rosin, modified rosin esters, resins of dibasic acids and alkyl fatty alcohols, polyesters of molecular weight 1500-30,000 based on dihydric alcohols and dibasic acids, 4-(4-hydroxyphenyl)butan-2-one, 3-ethoxy-4-hydroxybenzaldehyde and combinations thereof.

The propellant may comprise additional layers. Suitable layers include a layer of a second burn rate modifier, a finishing layer, an ignition layer and/or a layer of a second energetic material.

To aid further description, in embodiments where there is a layer of a second burn rate modifier, the original layer of burn rate modifier will be referred to as the "first burn rate modifier". The second burn rate modifier(s) is generally different to the first burn rate modifier. In some embodiments, the second burn rate modifier may be a compound of formula 1 which is different to the compound of formula 1 that is the first burn rate modifier. In other embodiments, the second burn rate modifier can be selected from the range of burn rate modifiers described above. When the propellant comprises a second layer of a different burn rate modifier, the layers of burn rate modifiers may be in any order. For example, the propellant may comprise energetic material, a first layer of a burn rate modifier which can be selected from the range of burn rate modifiers described above and a second layer of a compound of formula 1. Alternatively, the propellant may comprise energetic material, a first layer of a compound of formula 1 and a second layer of a burn rate modifier which can be selected from the range of burn rate modifiers described above. Alternatively, the first and second burn rate modifiers may be applied together so that there is a single layer comprising the first and second burn rate modifiers.

In one particularly preferred embodiment, the propellant comprises energetic material, a first layer of 4-(4-hydroxyphenyl)butan-2-one and a second layer of a compound of formula 1. In some embodiments, the compound of formula 1 is glycerol tribenzoate.

Dispersion of a compound of formula 1 throughout a granule as a plasticizer does not eliminate the ability of the compound to function as a burn rate modifier.

As explained above, the propellant may comprise a compound of formula 1 in the form of a coating on granules of an energetic material with a layer of an additional burn rate modifier. In a comparative arrangement, the propellant may comprise a compound of formula 1 dispersed (as a plasticizer) throughout granules of an energetic material (instead of as coating) with a layer of an additional burn rate modifier.

In embodiments where there is a layer of second energetic material, the energetic material that forms the core of the propellant will be referred to as a first energetic material. The layer of second energetic material can be selected from the range of energetic materials described above. The layer of second energetic material is usually different to the first energetic material. In a preferred embodiment, the first energetic material is nitrocellulose and the layer of second energetic material is nitroglycerin. The layer of second energetic material is generally in contact with the first energetic material.

In some embodiments, the propellant comprises a nitrocellulose core, a layer of nitroglycerin in contact with the nitrocellulose and a layer of a compound of formula 1 in contact with the nitroglycerin layer. In preferred embodiments, the compound of formula 1 is glycerol tribenzoate.

In embodiments where the propellant comprises an ignition layer, the ignition layer comprises an ignition component. The ignition component may comprise a group I metal salt of nitrate.

In embodiments where the propellant comprises a finishing layer, the finishing layer may be in the form of a graphite layer. Surface-graphiting is typically the final finishing step, yet graphiting may be completed prior to or after drying the propellant. In some embodiments, the graphite finishing layer may comprise an ignition component. Examples of suitable ignition components include one or more group I metal salt of nitrate. The finishing layer is generally the outermost layer on the propellant. The additional layers may be complete layers around the propellant or they may be partial layers.

Coating

The coating of the energetic material may be performed by any method known in the art. For example, the granules of energetic material may be immersed in the compound of formula 1, or the compound of formula 1 may be tumble coated or spray coated onto the granules of energetic material. The compound of formula 1 may be applied as a neat liquid, powder, emulsion or as a solution.

In some embodiments, the energetic material is coated with the compound of formula 1 in a vessel. Suitable vessels include, but are not limited to, a tumble coater, granulators, shaping tubes, augers and ribbon blenders based on the half-pipe shape with sigmoidal or helical mixing blades.

In some embodiments, the coating is applied to the granules of energetic material in a vessel known in the art as a "sweetie barrel" or "tumbler". This vessel may also be known as a rotating tumbler or a tumble coater. Such a vessel will be referred to herein as a "tumble coater". In these embodiments, the granules of energetic material are added to the tumble coater, the tumble coater drum is rotated to cause tumbling of the granules, and then the compound of formula 1 is added to coat the granules as they tumble. In some embodiments, the compound of formula 1 is added in one portion. In other embodiments, the compound of formula 1 is added portion-wise so that the granules are coated gradually. Heat may be applied as required to warm the ingredients in the tumble coater and melt the compound of formula 1. Heat may be applied by any method known in the art. In some embodiments, steam heating is used. In other embodiments, heating is effected by heat jacketing the vessel. The application of heat enables the compound of formula 1 to coat the granules, and may enhance diffusion of the compound of formula 1 into the surfaces of the propellant granules.

In some embodiments, the granules of energetic material and compound of formula 1 are mixed in a vessel under ambient conditions. Preferably, the vessel is a tumble coater or a ribbon blender. The vessel may be of any size suitable to coat a desired quantity of granules. For example, the vessel may be of a size suitable to coat several hundred kilograms of granules per batch, or up to one or more tonnes of granules per batch. The vessel is then closed and heated, for example by adding steam, or through use of a heat jacketed vessel. The heat (steam) softens and melts the compound of formula 1 to enable it to form a coating on granules of energetic material. Any clumps forming are broken up in situ through the process of tumbling and the presence of moisture. This process is continued until the coated product is produced. Moisture or solvent may be present in sufficient quantity to reduce the stickiness of the grains one to another while the compound of formula 1 is being melted onto the grains. In some embodiments the process is continued for up to about 150 minutes ("run time"). For example, the process may be continued for up to about 120 minutes, such as up to about 90 minutes, or up to about 60 minutes, or up to about 30 minutes.

The temperature to which the vessel needs to be heated (and therefore the amount of steam that needs to be added) depends upon the temperature required to soften and melt the compound of formula 1. In some embodiments, the vessel is heated to a temperature of at least about 50° C. For example, the temperature may be at least about 60° C., such as at least about 65° C., or at least about 70° C., or at least about 80° C. In some embodiments, the temperature is at least about 85° C., for example, at least about 90° C., or at least about 95° C.

The coating of the compound of formula 1 need not stay as a separate outer layer on the surface of the energetic material granule. The compound of formula 1 may diffuse, or penetrate, partly, or entirely, into a surface or sub-surface layer of the energetic material. In such cases, the compound of formula 1 extends from within the grain to the surface layer. The compound of formula 1 may be distributed evenly from the surface or may be distributed unevenly within the granules. The compound of formula 1 may be in a band or region of the granule that is largely of uniform size per granule.

If the compound of formula 1 is applied in a manner such that it diffuses into the energetic material, the compound of formula 1 may come into contact with a number of the propellant components.

The term coating will be understood to refer to all such forms of coating including coating that remains on the surface of the granule and coating that has diffused into the surface. In particular, the expression "coating on the surface of the granules" includes coating that remains on the surface of the granule and coating that has diffused into the granule.

Where diffusion of the compound of formula 1 occurs into the granule of energetic material, the layer of diffused compound of formula 1 may be referred to as a deterred band or deterred region. In the following, where we refer to a thickness of a coating, this is the equivalent to the thickness of the deterred band for embodiments where the coating has diffused into the surface of the granule.

The thickness of the coating (i.e. the thickness of the deterred band) may be any thickness which allows the compound of formula 1 to slow the burn rate of the energetic material in an appropriate manner. In some embodiments, the thickness of the coating is about 10 to about 700 μm. For example, the thickness may be about 15 to about 500 μm, such as about 20 to 400 μm, or about 50 to 300 μm.

The depth to which the compound of formula 1 diffuses into the granule of energetic material may depend on how long the granule is in contact with the compound, the concentration of the compound being applied, the temperature at which the coating is being performed and/or the chemical interaction between the propellant matrix and the compound. For example, to obtain a thinner deterred band, a rapid initial temperature ramp can be used and/or a shorter run time may be used. To obtain a thicker deterred band, a slower initial temperature ramp and/or a longer run time can be used. Furthermore, changing the propellant matrix composition may change the depth of penetration, and therefore the thickness of the deterred band, under predetermined operating conditions.

Additional means of managing diffusion of the compound into the granule are available, including the non-limiting technique of solvation. During solvation, compounds of formula 1 may be dissolved in various organic solvents and applied to the granules as a solution that diffuses into the granules, carrying with it the compound of formula 1 which is deposited within the granules at a depth that is related to temperature, solubility and the concentration of solution. The solvation techniques include the application to granules of propellant of solutions of compounds of formula 1, solvents to manage the transport of compounds of formula 1 and emulsions of compounds of formula 1.

Preferably, the compound of formula 1 is diffused into the granules of energetic material with an exponential concentration profile such that the exponential decay curve approximates the concentration profile. In other words, the concentration of the burn rate modifier is at a maximum some point below the granular surface, and the concentration decreases approximately exponentially as measured at increasing depth of penetration into the deterred region and outward from the deterred region.

The compound of formula 1 is a triester. Such triesters commonly contain a small amount of the corresponding di-ester and mono-ester. Commercially available triesters of formula 1 may contain up to 10% by weight in total of impurities. The impurities may include the di-ester and the mono-ester, usually with the di-ester present in a greater quantity than the mono-ester. Alternatively, the impurities may include either the di-ester or the mono-ester. Water (moisture) may be an additional impurity. The amount of impurities included in the triester compound of formula 1 is preferably not more than about 10% by weight of the total triester source, more preferably not more than about 8% by weight.

The presence of impurities can change the melting point of the burn rate modifier and/or plasticiser. Increasing amounts of mono-ester and di-ester components increases the degree of melting point variation. It is not desirable for a burn rate modifier to have a melting point below about 50° C. as deterrent migration increases with reduced melting point. The inclusion of such impurities in a total amount of up to about 10% by weight can be accommodated in burn rate modifiers of the present application. Since the melting point is not a significant factor in the use of the triester as a plasticiser, it will be appreciated that the plasticisers of the present application may contain greater than 10% of components other than the triester, and may, for example, contain in excess of 10% of each of the di- and mono-esters.

When the compound of formula 1 is present as a burn rate modifier, or plasticizing burn rate modifier, the compound of formula 1 is present in the propellant in an amount which is sufficient to retard the burn rate of the outer surface of the granule of energetic material compared with the burn rate without the presence of the compound. In some embodiments, the compound of formula 1 is present in amounts of from about 0.1 to about 10% by weight of the propellant. For example, the compound of formula 1 may be present in an amount of about 0.2 to about 8%, such as about 0.5 to about 6.5%, or about 0.7 to about 6%. Most preferably, the compound of formula 1 is present in an amount of about 1 to about 5% by weight of the propellant.

Expressed another way, the ratio of compound of formula 1 to propellant may be about 1:1000 to about 1:10 by weight, or about 1:500 to about 1:12.5 by weight, or about 1:200 to about 1:15.5 by weight, or about 1:140 to about 1:16.5 by weight, or about 1:100 to about 1:20 by weight.

When the compound of formula 1 is present as a plasticizer, the compound of formula 1 is present in the propellant in an amount which is sufficient to impart homogeneity and plasticity to the energetic material. In some embodiments, the compound of formula 1 is present as a plasticizer in an amount of about 0.01% to about 8% by weight of the propellant, such as about 0.02% to about 7%, or about 0.3% to about 6%. Most preferably, the compound of formula 1 is present as a plasticizer in an amount of about 0.05% to about 5% by weight of the propellant.

The compound of formula 1 may coat the whole surface of the granule. Alternatively, the compound of formula 1 may coat part of the surface of the granule. For example, the compound of formula 1 may coat the outer surface of the granule, or the compound of formula 1 may coat the surface of the granule within the perforated region, or the compound of formula 1 may coat both the outer and inner surfaces of the granule.

When the compound of formula 1 is present as a plasticizer, the compound of formula 1 is dispersed throughout the granule of energetic material. The compound of formula 1 may be dispersed throughout granules of energetic material by any known technique. For example, the compound of formula 1 may be dispersed throughout granules of energetic material by blending the energetic material and compound of formula 1 together in a mixer and extruding the resulting mixture.

In some embodiments, the propellant may comprise a second layer of a different burn rate modifier. In some embodiments, the second layer may comprise a compound of formula 1 which is different to the compound of formula 1 in the first layer. In other embodiments, the second layer may comprise any burn rate modifier known in the art. Examples of suitable burn rate modifiers include, but are not limited to, dintirotoluene, Acetyl triethyl citrate, Triethyl citrate, Tri-n-butyl citrate, Tributyl acetyl citrate, Acetyl tri-n-butyl citrate, Acetyl tri-n-hexyl citrate, n-Butyryl tri-n-hexylcitrate, Di-n-butyl adipate, diisopropyl adipate, Diisobutyl adipate, Diethylhexyl adipate, Nonyl undecyl adipate n-Decyl-n-octyl adipate, Dibutoxy ethoxy ethyl adipate Dimethyl adipate, Hexyl octyl decyl adipate Diisononyl adipate, Dibutyl phthalate, Diethyl phthalate, Diamyl phthalate, Nonylundecyl phthalate, Bis(3,5,5-trimethylhexyl) phthalate, Di-n-propyladipate, Di-n-butyl sebacate, Dioctyl sebacate, Dimethyl sebacate, Diethyl diphenyl urea, Dimethyl diphenyl urea, Di-n-butyl phthalate, Di-n-hexyl phthalate, Dinonyl undecyl phthalate, Nonyl undecyl phthalate, Dioctyl terephthalate, Dioctyl isophthalate, 1,2-Cyclohexane dicarbonic acid diisononylester, Dibutyl maleate, Dinonyl maleate, Diisooctyl maleate, Dibutyl fumarate, Dinonyl fumarate, Dimethyl sebacate, Dibutyl sebacate, Diisooctyl sebacate, Dibutyl azelate, Diethylene glycol dibenzoate, Trioctyl trimelliate, Trioctyl phosphate, Butyl stearate, Methylphenylurethane, N-methyl-N-phenylurethane, Ethyl diphenyl carbamate, camphor, gum Arabic, gelatin, rosin, modified rosin esters, resins of dibasic acids and alkyl fatty alcohols, polyesters of molecular weight 1500-30,000 based on dihydric alcohols and dibasic acids, 4-(4-hydroxyphenyl)butan-2-one, 3-ethoxy-4-hydroxybenzaldehyde, and combinations thereof.

Additives

In some embodiments, the propellant further comprises an additive selected from the group consisting of stabilisers, flash suppressants, barrel-wear ameliorants and combinations thereof.

In some embodiments, the additive is incorporated within the energetic material granules. In other embodiments, the additive is incorporated with the compound of formula 1. In still other embodiments, the additive may be incorporated within the energetic material granules and with the compound of formula 1. Incorporation of the additive within the energetic material granules can be achieved by adding the additive to the slurry or dough of energetic material, which is then formed into granules.

The term "stabilizer" refers to any compound which can be used to stabilize the energetic material. In some embodiments, the stabilizer may be selected from the group consisting of sodium hydrogen carbonate, calcium carbonate, magnesium oxide, akardites, centralites, 2-nitrosodiphenylamine, diphenylamine, N-methyl-p-nitroaniline and combinations thereof.

The term "flash suppressant", refers to any compound which can be used to suppress the muzzle flash of a firearm. In some embodiments, the flash suppressant may be selected from the group consisting of potassium salts of organic acids, potassium sulphate, potassium carbonate, potassium bicarbonate and combinations thereof.

The term "barrel-wear ameliorants" refers to any compound which can be used to reduce barrel-wear. In some embodiments, the barrel-wear ameliorant may be selected from the group consisting of bismuth, bismuth oxide, bismuth citrate, bismuth subcarbonate, lead, lead carbonate, other salts of lead and bismuth and combinations thereof.

The propellant may also comprise a plasticizer in addition to or instead of the compound of formula 1. In some embodiments, the plasticizer may be selected from the group consisting of diethylphthalate, camphor, dibutylphthalate, di-n-propyl adipate, methylphenyl urethane, calcium stearate, butyl stearate, nitroglycerin and combinations thereof.

Ammunition

In one embodiment, there is provided an ammunition cartridge comprising the propellant. The ammunition cartridge typically comprises a casing, the propellant described above, a primer and a projectile.

The propellant of the present invention is suitable for use in a wide range of firearms. It is particularly suitable for use in .22-.224 calibre firearms, .243 calibre firearms, .27 calibre firearms, 6 mm calibre firearms, 7 mm calibre firearms .30 calibre firearms, 8 mm calibre firearms, .338 calibre firearms up to .50 calibre firearms and is even suitable for medium to large calibre firearms.

The casing may be made of any material which is tough enough and thick enough to not rupture during burning of the propellant. The casing may be of any size and the size will depend upon the firearm in which the cartridge is to be used. Conventional casing materials and construction is well known in the art and applies to the present application.

The primer, or priming compound, may be comprised of any substance which is capable of producing heat to ignite the propellant. Examples of priming compounds include but are not limited to lead azide (dextrinated), lead styphnate, mercury fulminate and combinations thereof. In some embodiments, the priming compound is ASA (aluminium, lead styphnate, lead azide).

The projectile may be any object which can be projected from the muzzle of a firearm system upon burning of the propellant. Examples of projectiles include, but are not limited to, bullets, shot, pellets, slugs, shells, balls, buckshot, bolts, rockets and cannon balls. In some embodiments, the projectile is selected from the group consisting of a bullet, pellet, slug and ball.

Advantages

The compounds of formula 1 contain only carbon, hydrogen, oxygen and in some cases nitrogen molecules and do not contain any potentially toxic or hazardous elements such as halogens. The compounds are less toxic than DNT, are compatible with energetic materials such as nitrocellulose and are stable over time (both chemically and ballistically). The compounds of formula 1 have burn rate modification properties just as good as DNT, but without the drawbacks of toxicity and carcinogenicity. In fact, the compounds of formula 1 have surprisingly better burn rate modification properties than even the industry-preferred DNT, making them suitable for use in propellants and ammunition cartridges.

EXAMPLES

The invention will now be described with reference to the following non-limiting Examples.

TABLE 1

| Burn rate modifier | % w/w | Propellant oxygen balance % | Gas @ STP (L/g) | Gas @ 2950 K (L/g) |
|---|---|---|---|---|
| DNT | 6.5 | −34.0 | 0.96 | 9.47 |
| 4-(4-hydroxyphenyl) butan-2-one/Glycerol tribenzoate | 2.0 | −32.2 | 0.95 | 9.37 |
| Nitroglycerin/Glycerol tribenzoate | 13/3.5 | −30.5 | 0.94 | 9.29 |
| Nitroglycerin/Glycerol tribenzoate | 16/3.5 | −29.5 | 0.94 | 9.24 |

The burn rate modifier glycerol tribenzoate, alone or in combination with nitroglycerin, was subjected to comparative tests against DNT. The results of some tests are set out in Table 1 above. The comparative test work involved preparing granules of nitrocellulose energetic material having an average length of about 1.4 mm and an average diameter of about 0.7 mm. The granules had a single central perforation of approximately 50 μm diameter. The granules were coated with DNT or glycerol tribenzoate or glycerol tribenzoate and nitroglycerin in the amounts outlined in the Table to form propellant. The data showed that the propellant oxygen balance for the propellant double deterred with glycerol tribenzoate and 4-(4-hydroxyphenyl)butan-2-one was −32.2% compared with −34.0% for the DNT propellant and that the propellant oxygen balance for the nitroglycerin/glycerol tribenzoate combination was −30.5% and −29.5% for 13 wt % nitroglycerin and 16 wt % nitroglycerin, respectively.

The data also showed that the gas at standard temperature and pressure for the glycerol tribenzoate double deterred propellant was 0.95 L/g compared with 0.96 L/g for the DNT propellant and the gas at 2950K for glycerol tribenzoate double deterred propellant was 9.37 L/g compared with 9.47 L/g for the DNT propellant. The data also show that the gas at standard temperature and pressure for the 13 wt % nitroglycerin/glycerol tribenzoate propellant and the 16 wt % nitroglycerin/glycerol tribenzoate propellant was 0.94 L/g and that the gas at 2950K for the 13 wt % nitroglycerin/glycerol tribenzoate propellant was 9.29 L/g and for the 16 wt % nitroglycerin/glycerol tribenzoate propellant was 9.24 L/g.

These data demonstrate that glycerol tribenzoate or nitroglycerin/glycerol tribenzoate is a good substitute for DNT. In fact, glycerol tribenzoate or double deterred systems can be used in lower amounts than DNT and achieve a similar result.

The propellants were subsequently loaded into cartridges and fired under test conditions in an indoor range measuring case-conformal chamber pressure with electronic piezometers and projectile velocity with electronic shot-traverse-detection screens connected to an analytical apparatus that processes the raw sensor data for each shot. The ballistic comparisons are seen in FIGS. 2 and 3.

FIG. 1 is a schematic illustration showing the composition of a propellant according to one embodiment of the invention. The propellant shown in FIG. 1 is in the form of a granule having a single, central perforation. The energetic material (1) has been coated in a layer of the burn rate modifier of the invention (3). The propellant may comprise a second layer of a different burn rate modifier (2) or this region may represent more energetic material. In this embodiment, the burn rate modifier is coated on the outside surface of the granule and the surface of the granule within the perforated region. The propellant further comprises an ignition layer (4), which is optionally covered with a surface glaze of graphite, but may contain other materials known to those familiar with the art—for example metal salts of nitrate.

The propellant granule of FIG. 1 may be prepared by extruding a dough or slurry of energetic material with a single central perforation to form an extrudate cord, and by then cutting the extrudate cord to the required length. The granule may then be dried during which it may contract slightly. The granule may then be coated in a first layer of burn rate modifier (and optionally a second layer of a different burn rate modifier) and finally coated with the ignition layer.

Figure 2:
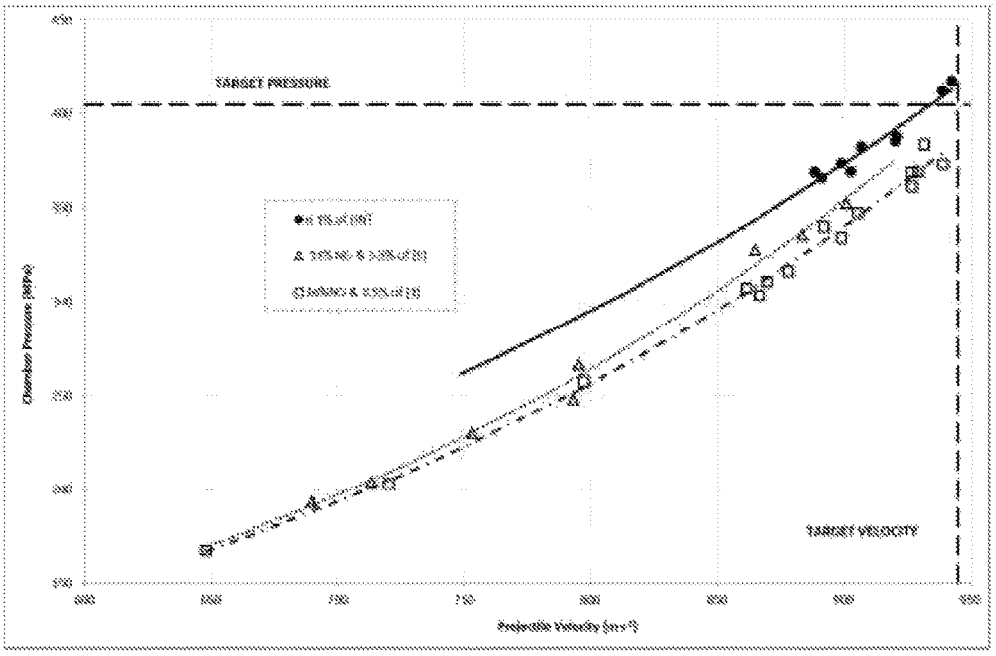
FIG. 2 is a graph showing pressure v velocity for a cartridge comprising an energetic material coated with glycerol tribenzoate plotted alongside a comparable energetic material coated with DNT, when fired from a proof barrel.
Figure 3:
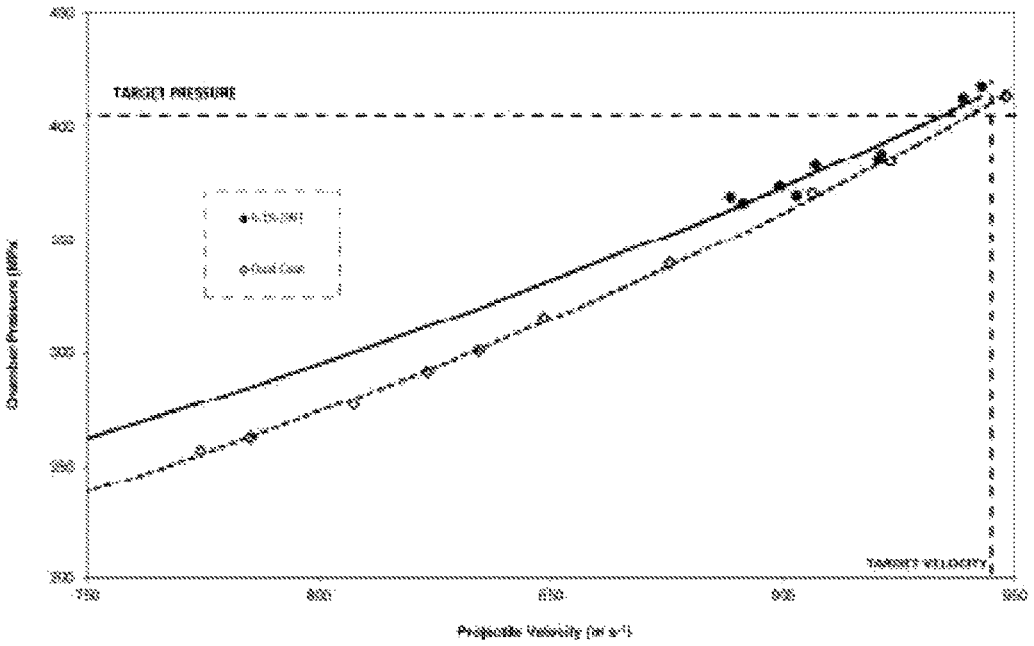
FIG. 3 is a graph showing pressure v velocity for a cartridge comprising an energetic material coated either with DNT or a double-deterred composition incorporating 4-(4-hydroxyphenyl)butan-2-one and glycerol tribenzoate, when fired from a proof barrel.

FIG. 2 shows a performance comparison plot for pressure and velocity for DNT-coated nitrocellulose propellant (approximately 1.4 mm long, 0.7 mm diameter and 50 μm perforation) against experimental 16% nitroglycerin (NG) and 3.5% glycerol tribenzoate (GTB)-coated nitrocellulose propellant (approximately 1.4 mm long, 0.7 mm diameter and 50 micron perforation) and experimental 13% nitroglycerin and 3.5% glycerol tribenzoate-coated propellant (approximately 1.4 mm long, 0.7 mm diameter and 50 micron perforation) (energetic material coated at 75° C.). The ammunition build was consistent with the internationally recognised SS109 5.56 mm build, denoted 5.56 mm Ball F1 in Australia. FIG. 2 demonstrates that the DNT propellant is inferior to the nitroglycerin/glycerol tribenzoate propellant variants in respect of achieving the target performance.

FIG. 3 shows the performance comparison plot for pressure and velocity for DNT-coated propellant (approximately 1.4 mm long, 0.7 mm diameter and 50 micron perforation) against an experimental propellant with a double layer of deterrents including 1% 4-(4-hydroxyphenyl)butan-2-one (ketone) and 1% glycerol tribenzoate (GTB). The ammunition build was the 5.56 mm Ball F1. FIG. 3 demonstrates that the DNT propellant is inferior to the double deterred propellant in respect of achieving the target performance.

FIGS. 2 and 3 demonstrate that the energetic material comprising a compound of formula 1 can be used together with another energetic material or burn rate modifier to produce a propellant.

Dispersion of a compound of formula 1 throughout a granule as a plasticizer does not eliminate the ability of the compound to function as a burn rate modifier. Consequently, coating 4-(4-hydroxyphenyl)butan-2-one onto a granule comprising dispersed glycerol tribenzoate would provide a propellant having an effect similar to that exemplified in FIG. 3 where the granule comprises a double layer of burn rate modifiers including 4-(4-hydroxyphenyl)butan-2-one and glycerol tribenzoate (GTB).

It will be appreciated by persons skilled in the art that numerous variations and/or modifications may be made to the invention as shown in the specific embodiments without departing from the spirit or scope of the invention as broadly described. The present embodiments are, therefore, to be considered in all respects as illustrative and not restrictive.

In the claims which follow and in the preceding description of the invention, except where the context requires otherwise due to express language or necessary implication, the word "comprise" or variations such as "comprises" or "comprising" is used in an inclusive sense, i.e. to specify the presence of the stated features but not to preclude the presence or addition of further features in various embodiments of the invention.

The invention claimed is:

1. A propellant comprising:

an energetic material in the form of granules; and a compound of formula 1

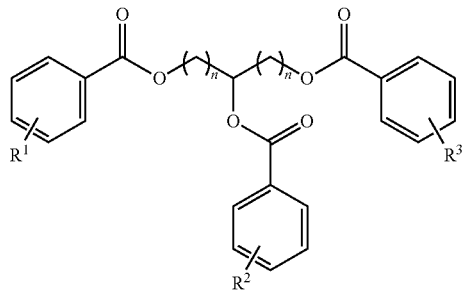

wherein $R^1$ is selected from the group consisting of —H, —OH, —O($C_{1-4}$alkyl),—$C_{1-4}$alkyl,—NH$C_{1-4}$alkyl, —N($C_{1-4}$alkyl)$_2$, —$NO_2$, —$NHNH_2$, —N($C_{1-4}$alkyl)$NH_2$, and —CN;

$R^2$ is selected from the group consisting of —H, —OH, —O($C_{1-4}$alkyl), —$C_{1-4}$alkyl,—NH$C_{1-4}$alkyl, —N($C_{1-4}$alkyl)$_2$, —$NO_2$, —$NHNH_2$, —N($C_{1-4}$alkyl)$NH_2$, and —CN;

$R^3$ is selected from the group consisting of —H, —OH, —O($C_{1-4}$alkyl), —$C_{1-4}$alkyl,—NH$C_{1-4}$alkyl, —N($C_{1-4}$alkyl)$_2$, —$NO_2$, —$NHNH_2$, —N($C_{1-4}$alkyl)$NH_2$, and —CN; and n is an integer from 1 to 4.

2. The propellant according to claim 1, wherein the granules comprise a perforation.

3. The propellant according to claim 1, wherein the energetic material is selected from the group consisting of carbon black powder, ammonium perchlorate, hexogen, butanetrioltrinitrate, ethyleneglycol dintrate, diethyleneglycol dinitrate, erithritol tetranitrate, octogen, hexanitroisowurtzitane, metriol trinitrate, N-Methylnitramine, pentaerythritol tetranitrate, tetranitrobenzolamine, trinitrotoluene, nitroglcerine, nitrocellulose, mannitol hexanitrate, triethylene glycoldinitrate, guanidine, nitroguanidine, 3-nitro-1,2,4-triazol-5-one, ammonium nitrate, propanediol dinitrate, hexamine, 5-aminotetrazole, methyltetrazole, phenyltetrazole, polyglycidylnitrate, polyglycidylazide, poly[3-nitratomethyl-3-methyloxitane], poly[3-azidomethyl-3-methyloxitane], poly[3,3-bis(azidomethyl)oxitane], nitrated cyclodextrin polymers, poly glycidylnitrate, and combinations thereof.

4. The propellant according to claim 1, wherein the energetic material is nitrocellulose.

5. The propellant according to claim 1, wherein the compound of formula 1 is in the form of a coating on the surface of the granules.

6. The propellant according to claim 1, wherein the compound of formula 1 is dispersed throughout the granules.

7. The propellant according to claim 1, wherein the compound of formula 1 is dispersed throughout the granules and is in the form of a coating on the surface of the granules.

8. The propellant according to claim 1, further comprising a graphite layer.

9. A method of preparing a propellant, comprising coating granules of an energetic material with a compound of formula 1 or dispersing a compound of formula 1 throughout an energetic material and granulating the energetic material, wherein the compound of formula 1 is:

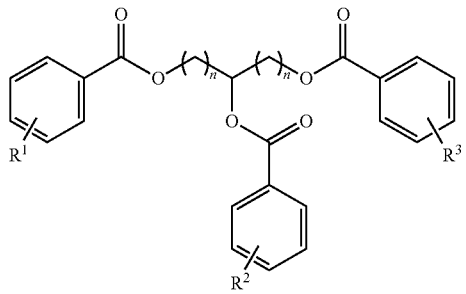

wherein $R^1$ is selected from the group consisting of —H, —OH, —O($C_{1-4}$alkyl),—$C_{1-4}$alkyl,—NHC$_{1-4}$alkyl, —N($C_{1-4}$alkyl)$_2$, —$NO_2$, —$NHNH_2$, —N($C_{1-4}$alkyl)$NH_2$, and —CN;

$R^2$ is selected from the group consisting of —H, —OH, —O($C_{1-4}$alkyl),—$C_{1-4}$alkyl,—NHC$_{1-4}$alkyl, —N($C_{1-4}$alkyl)$_2$, —$NO_2$, —$NHNH_2$, —N($C_{1-4}$alkyl)$NH_2$, and —CN;

$R^3$ is selected from the group consisting of —H, —OH, —O($C_{1-4}$alkyl),—$C_{1-4}$alkyl,—NHC$_{1-4}$alkyl, —N($C_{1-4}$alkyl)$_2$, —$NO_2$, —$NHNH_2$, —N($C_{1-4}$alkyl)$NH_2$, and —CN; and n is an integer from 1 to 4.

10. The method according to claim 9, wherein the granules of energetic material are formed by extruding a slurry of the energetic material to form an extrudate cord and cutting the extrudate cord.

11. The method according to claim 10, wherein the energetic material is extruded with a perforation.

12. The method according to claim 9, wherein the compound of formula 1 is diffused into the granules of energetic material.

13. An ammunition cartridge comprising a propellant according to claim 1.

14. The ammunition cartridge according to claim 13, comprising a casing, a primer and a projectile.

15. The propellant according to claim 1, wherein the compound of formula 1 is glycerol tribenzoate.

16. The propellant according to claim 1, wherein the energetic material is selected from the group consisting of carbon black powder, ammonium perchlorate, hexogen, butanetrioltrinitrate, ethyleneglycol dintrate, diethyleneglycol dinitrate, erithritol tetranitrate, octogen, hexanitroisowurtzitane, metriol trinitrate, N-Methylnitramine, pentaerythritol tetranitrate, tetranitrobenzolamine, trinitrotoluene, nitroglcerine, nitrocellulose, mannitol hexanitrate, triethylene glycol dinitrate, guanidine, nitroguanidine, 3-nitro-1,2,4-triazol-5-one, ammonium nitrate, propanediol dinitrate, hexamine, 5-aminotetrazole, methyltetrazole, phenyltetrazole, polyglycidylnitrate, polyglycidylazide, poly[3-nitratomethyl-3-methyloxitane], poly[3-azidomethyl-3-methyloxitane], poly[3,3-bis(azidomethyl)oxitane], nitrated cyclodextrin polymers, poly glycidylnitrate, and combinations thereof.

17. The method according to claim 9, wherein the compound of forumula 1 is glycerol tribenzoate.

18. The method according to claim 9, wherein the energetic material is selected from the group consisting of carbon black powder, ammonium perchlorate, hexogen, butanetrioltrinitrate, ethyleneglycol dintrate, diethyleneglycol dinitrate, erithritol tetranitrate, octogen, hexanitroisowurtzitane, metriol trinitrate, N-Methylnitramine, pentaerythritol tetranitrate, tetranitrobenzolamine, trinitrotoluene, nitroglcerine, nitrocellulose, mannitol hexanitrate, triethylene glycol dinitrate, guanidine, nitroguanidine, 3-nitro-1,2,4-triazol-5-one, ammonium nitrate, propanediol dinitrate, hexamine, 5-aminotetrazole, methyltetrazole, phenyltetrazole, polyglycidylnitrate, polyglycidylazide, poly[3-nitratomethyl-3-methyloxitane], poly[3-azidomethyl-3-methyloxitane], poly[3,3-bis(azidomethyl)oxitane], nitrated cyclodextrin polymers, poly glycidylnitrate, and combinations thereof.

19. An ammunition cartridge comprising a propellant comprising an energetic material; and a compound of formula 1:

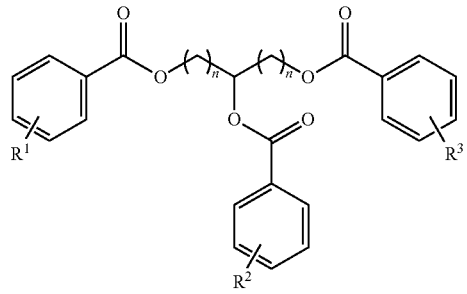

wherein $R^1$ is selected from the group consisting of —H, —OH, —O($C_{1-4}$alkyl),—$C_{1-4}$alkyl,—NHC$_{1-4}$alkyl, —N($C_{1-4}$alkyl)$_2$, —$NO_2$, —$NHNH_2$, —N($C_{1-4}$alkyl)$NH_2$, and —CN;

$R^2$ is selected from the group consisting of —H, —OH, —O($C_{1-4}$alkyl),—$C_{1-4}$alkyl,—NHC$_{1-4}$alkyl, —N($C_{1-4}$alkyl)$_2$, —$NO_2$, —$NHNH_2$, —N($C_{1-4}$alkyl)$NH_2$, and —CN;

$R^3$ is selected from the group consisting of —H, —OH, —O($C_{1-4}$alkyl),—$C_{1-4}$alkyl,—NHC$_{1-4}$alkyl, —N($C_{1-4}$alkyl)$_2$, —$NO_2$, —$NHNH_2$, —N($C_{1-4}$alkyl)$NH_2$, and —CN; and n is an integer from 1 to 4.

20. A propellant comprising:

an energetic material in the form of granules; and a compound of formula 1:

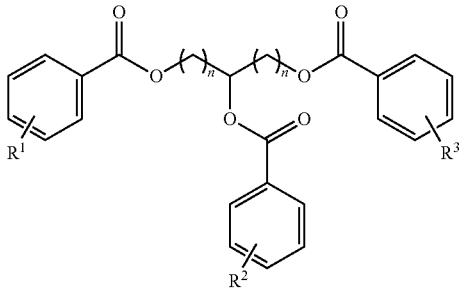

wherein $R^1$ is selected from the group consisting of —H, —OH, —O($C_{1-4}$alkyl),—$C_{1-4}$alkyl,—NH$C_{1-4}$alkyl, —N($C_{1-4}$alkyl)$_2$, —$NO_2$, —$NHNH_2$, —N($C_{1-4}$alkyl)$NH_2$, and —CN;

$R^2$ is selected from the group consisting of —H, —OH, —O($C_{1-4}$alkyl),—$C_{1-4}$alkyl,—NH$C_{1-4}$alkyl, —N($C_{1-4}$alkyl)$_2$, —$NO_2$, —$NHNH_2$, —N($C_{1-4}$alkyl)$NH_2$, and —CN;

$R^3$ is selected from the group consisting of —H, —OH, —O($C_{1-4}$alkyl),—$C_{1-4}$alkyl,—NH$C_{1-4}$alkyl, —N($C_{1-4}$alkyl)$_2$, —$NO_2$, —$NHNH_2$, —N($C_{1-4}$alkyl)$NH_2$, and —CN; and n is an integer from 1 to 4, and wherein:

the compound of formula 1 is in the form of a coating on the granules, or the compound of formula 1 is dispersed throughout the granules, or the compound of formula 1 is dispersed throughout the granules and is in the form of a coating on the granules.

* * * * *